US009009983B1

(12) United States Patent
Morris

(10) Patent No.: US 9,009,983 B1
(45) Date of Patent: Apr. 21, 2015

(54) CENTERLINE MARKER HOLDER USED FOR MARKING ROUNDED AND BULL NOSE VERTICAL AND HORIZONTAL WALL CORNERS

(71) Applicant: Kurt Morris, Erie, CO (US)

(72) Inventor: Kurt Morris, Erie, CO (US)

( * ) Notice: Subject to any disclaimer, the term of this patent is extended or adjusted under 35 U.S.C. 154(b) by 195 days.

(21) Appl. No.: 13/662,611

(22) Filed: Oct. 29, 2012

(51) Int. Cl.
*B25H 7/04* (2006.01)

(52) U.S. Cl.
CPC ..... *B25H 7/04* (2013.01)

(58) Field of Classification Search
CPC ..... B25H 7/04
USPC ..... 33/21.1, 520, 644, 32.2, 670, 672
See application file for complete search history.

(56) References Cited

U.S. PATENT DOCUMENTS

| | | | | | |
|---|---|---|---|---|---|
| 548,329 | A * | 10/1895 | Stemmerich | 33/332 |
| 2,117,023 | A * | 5/1938 | Eklov | 33/42 |
| 2,296,232 | A * | 9/1942 | Drain | 33/41.1 |
| 2,825,143 | A * | 3/1958 | Polivka | 33/520 |
| 2,829,436 | A * | 4/1958 | Leinwebber | 33/42 |
| 2,958,133 | A * | 11/1960 | Seitz | 33/42 |
| 3,075,294 | A * | 1/1963 | Strecker | 33/672 |
| 3,661,469 | A * | 5/1972 | Leff et al. | 408/72 R |
| 5,862,601 | A * | 1/1999 | O'Brien et al. | 33/42 |
| 5,940,979 | A * | 8/1999 | Ericksen et al. | 33/667 |
| 7,191,531 | B1 * | 3/2007 | Mitchell | 33/36 |
| 7,743,516 | B2 * | 6/2010 | Gross | 33/194 |
| 7,992,316 | B1 * | 8/2011 | Dickson | 33/562 |
| 2012/0055036 | A1 | 3/2012 | Bowman | |

* cited by examiner

*Primary Examiner* — Christopher Fulton
(74) *Attorney, Agent, or Firm* — Edwin H. Crabtree; Ramon L. Pizarro

(57) ABSTRACT

A centerline marker holder used for engaging and sliding along a portion of two intersecting walls and sliding along an exterior or interior rounded or bull nose corner between the walls. The marker holder uses a pencil for drawing a centerline along a length of the corner. The marker holder includes a flat, first wall engaging member attached at an angle to a flat, second wall engaging member. Along a length of an intersection of the first and second wall engaging members is a centerline hole. The centerline hole is dimensioned to receive the pencil therethrough for marking the centerline. The marker holder also includes a plurality of offset holes from the centerline hole for drawing parallel offset lines at a selected distance from the centerline.

11 Claims, 1 Drawing Sheet

CENTERLINE MARKER HOLDER USED FOR MARKING ROUNDED AND BULL NOSE VERTICAL AND HORIZONTAL WALL CORNERS

BACKGROUND OF THE INVENTION (a) Field of the Invention

This invention relates to a marker holder used for marking a centerline and more particularly, but not by way of limitation, to a handheld, portable centerline marker holder using a pencil or the like to mark a centerline on a rounded or bull nose exterior wall corner or a rounded or bull nose interior wall corner.

(b) Discussion of Prior Art

Heretofore, painters and wallpaperers use various types of chalk lines and level devices to draw a centerline on rounded and bull nose corners when transitioning from one wall color to an adjacent wall color or from painting one wall to wallpapering an adjacent wall. Using these types of devices is time consuming and not necessarily accurate. Also, a piece of corner bead molding is often used for trying to determine a centerline on rounded and bull nose corners. Further, painters quite often mix and blend two paint colors along an exterior or interior corner to avoid finding a centerline. The above problems related to finding and drawing an accurate centerline on a rounded or bull nose corner are eliminated by the unique features of the subject invention as described herein.

In U.S. Pat. No. 7,992,316 to Dickson, a system for masking trim and locating an arc of a bull-nose wall corner is disclosed. The system includes flexible planar sheets for masking surfaces adjacent the wall corner and a hand tool for locating a midpoint on the corner. In U.S. Patent Application No. 2012/0055036 to Bowman, an apparatus and method for surface marking an outside corner and using a marking tool. None of these prior art reference disclose the unique features, structure and operational function of the subject centerline marker holder as described herein.

SUMMARY OF THE INVENTION

In view of the foregoing, it is a primary objective of the subject centerline marker holder to provide a practical solution to quickly and easily draw a centerline along a length of a vertical or horizontal rounded or bull nose corner during residential or commercial building construction or during the remodeling of a home or office building.

Another object of the invention is the centerline marker holder is adapted for engaging both convex shaped, external corners and concave shaped, internal corners at an intersection of two walls. The walls can be vertical or horizontal walls and disposed at various angles to each other. The marker holder, by its construction, automatically finds a center of a corner when it is pressed against adjacent walls.

Still another object of the invention is the marker holder can be used with various types of crown molding, arches, and other curved wall structures where a centerline is required for internal and external corners. Also, the marker holder can be used to draw offset lines at the bottom of a corner for cutting baseboard trim to a proper length or at the top of the corner for cutting crown molding to proper length. Further, the marker holder can be made of wood, plastic, metal and like materials.

Yet another object of the centerline marker holder is the use of offset holes therein for drawing parallel offset lines from the centerline and used for different painted wall patterns or wall stripes.

Further, another object of the invention is the marker holder is portable, handheld, and can be used for drawing the centerline and offset lines on various vertical and horizontal corners and other curved wall surfaces.

The subject invention includes a centerline marker holder adapted for engaging a portion of two intersecting walls, sliding along a surface of the walls, and sliding along an exterior or interior rounded or bull nose corner. The marker holder uses a pencil or like marker for drawing a centerline along a length of the corner. The centerline marker holder includes a flat, first wall engaging member attached to a flat, second wall engaging member at various angles. Along a length of an intersection of the first and second wall engaging members is a centerline hole. The centerline hole is dimensioned to receive a pencil or the like therethrough for marking the centerline. The marker holder also includes a plurality of offset holes from the centerline hole for drawing parallel offset lines at a selected distance from the centerline.

These and other objects of the present invention will become apparent to those familiar with the marking of centerlines and offset lines on intersecting walls when painting or wallpapering when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the subject center line marker, and in which.

DETAILED DESCRIPTION OF THE PREFERRED EMBODIMENTS

Figure 1:
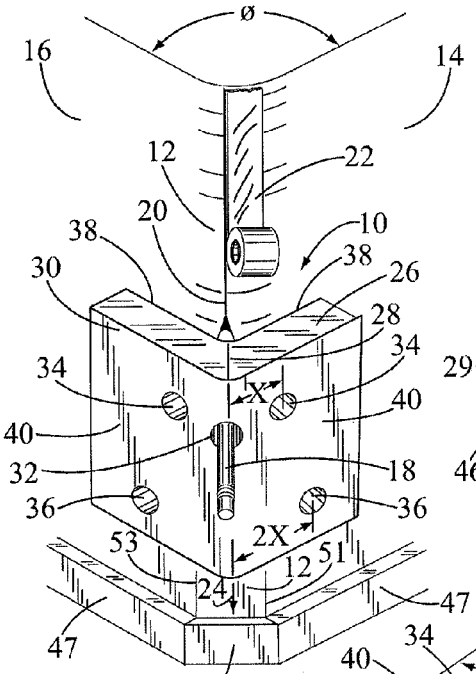
FIG. 1 is a perspective view of the subject centerline marker holder drawing a centerline along a length of a vertical, convex, rounded or bull nose exterior wall corner disposed between two vertical walls. Also, a roll of masking tape is shown being unrolled next to one side of the center line.

In FIG. 1, a perspective view of the subject handheld, portable, centerline marker holder is shown having a general reference numeral 10. The centerline marker holder 10 is adapted for engaging and sliding an exterior, rounded or bull nose corner 12 and sliding along a portion of a first vertical wall 14 and a second vertical wall 16. The two walls 14 and 16 are disposed at an angle "Φ" to each other. The marker holder 10 uses a pencil 18 or similar marking device for drawing a centerline 20.

While the drawings illustrate the use of the subject centerline marker holder 10 sliding on the surface of two walls intersecting at right angles, it is anticipated that the marker holder 10 can be used equally well for two vertical walls, two horizontal walls, or a vertical and horizontal wall, that intersect when the angle "Φ" is an acute angle or an obtuse angle.

In this drawing, a roll of masking tape 22 is shown being unrolled on one side of the centerline 20 and is used for painting on one side of the wall 16. Also shown in this drawing is the marker holder 10 being slid, as indicated by arrow 24, vertically downward to a bottom of the exterior corner 12, for drawing a complete centerline 20 along its length.

The centerline marker holder 10 includes a first end of a flat, first wall engaging member 26 attached to a first end of a flat, second wall engaging member 30 at various angles. The wall engaging members 26 and 30 can be rectangular, square or other geometric shapes. The angle between members 26 and 30 is created at an intersection 28 by beveling the first ends of the members 26 and 30 or the intersection 28 is created when the members 26 and 30 are molded at various angles to each other in a single piece unit. As mentioned above, the ends of the first and second wall engaging members 26 and 30 can also intersect at an acute or obtuse angle to engage two walls that don't intersect at right angles.

Centered along a length of the intersection 28 is a centerline hole 32. The centerline hole 32 is dimensioned to receive the pencil 18 therethrough and marking the centerline 20 as the marker holder 10 is slid along to the exterior corner 12. Also, the first and second wall engaging members 26 and 30 include a first offset hole 34, a distance "X" from the centerline hole 32, and a second offset hole 36, a distance "2X" from the centerline hole 32. The distance "X" can be, for example, in a range of ⅛, ¼, ½, ¾, or 1 inch and other measuring units. The distance "2X' can be an example of another offset location. The offset holes 34 and 36 are used for drawing parallel offset lines, as shown in FIG. 2, at a selected distance from the centerline 20.

The first and second wall engaging members 26 and 30 include a flat interior sliding surface 38 for engaging the exterior corner 12 and a portion of the walls 14 and 16. Also, the members 26 and 30 include a flat exterior sliding surface 40 for engaging a rounded or bull nose interior corner 44, as shown in FIG. 3.

Also shown in the bottom of FIG. 1 is baseboard trim 47 mounted at the bottom of the vertical walls 14 and 16. Without the use of the subject marker holder 10, it is difficult to measure and cut trim 47 and 49 to proper lengths. But, using the offset holes 34, the pencil 18 can be used to draw offset lines 51 and 53 and find the exact lengths of the trim 47 and 49 using the two parallel lines, as shown in this drawing. The ends of the two baseboard trim 47 and the adjacent ends of the corner baseline trim 49 can then be beveled at a 22½ degree angle to complete the baseboard trim, as shown for the rounded or bull nose corner 12.

Figure 2:
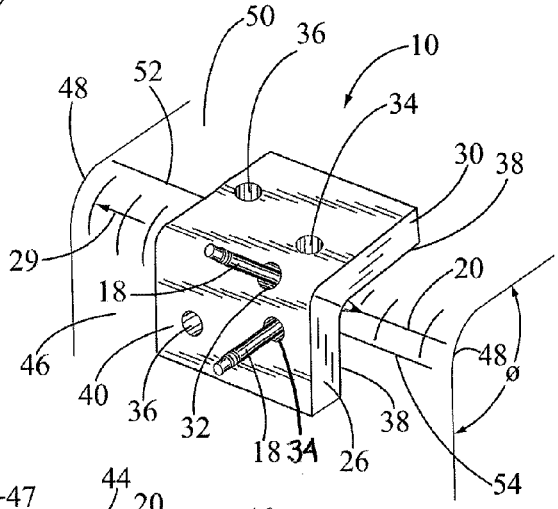
FIG. 2 is another perspective view of the centerline marker holder drawing a centerline and a parallel offset line along a length of a horizontal, convex, rounded or bull nose exterior wall corner disposed between a horizontal wall and a vertical wall.

In FIG. 2, the centerline marker holder 10 is shown with the flat, interior sliding surface 38 of the first and second wall engaging members 26 and 30 engaging a first vertical wall 46 and a first horizontal wall 50 with an exterior, rounded or bull nose corner 48 therebetween. In this drawing, an upper offset line 52 has already been drawn along a length of the exterior corner 48. Also shown in this drawing are two of the pencils 18 received in the centerline hole 32 and a first offset hole 34 for drawing the centerline 20 and a lower offset line 54.

Figure 3:
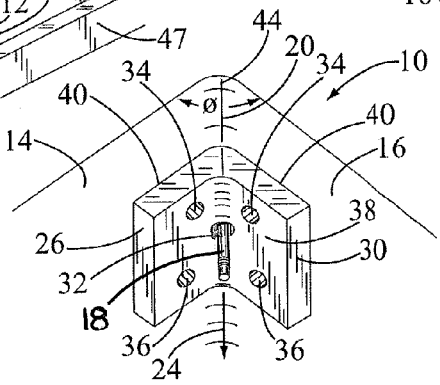
FIG. 3 is still another perspective view of the centerline marker holder drawing a centerline along a length of a vertical, concave, rounded or bull nose interior wall corner.

In FIG. 3, the centerline marker 10 has been turned around with the flat, exterior sliding surfaces 40 of the first and second wall engaging members 26 and 30 engaging a portion of the first vertical wall 14 and the second vertical wall 16 with the rounded or bull nose interior corner 44 disposed therebetween.

In this drawing, the marker holder 10 is moved downwardly, as indicated by arrow 24, and the pencil 18 received in the centerline hole 32 for drawing the centerline 20 as shown. Also, the centerline marker holder 10 will work equally well for drawing a centerline 20 should the interior corner 44 be disposed on a horizontal wall, similar to the horizontal wall 50, shown in FIG. 2.

Figure 4:
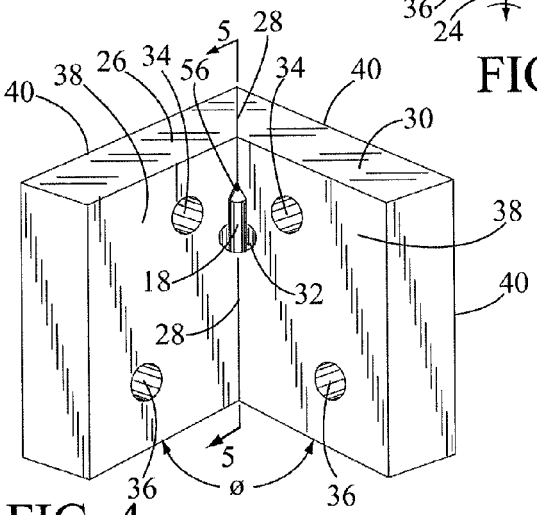
FIG. 4 is a perspective view of the interior sliding surfaces of the centerline marker holder and illustrating a centerline hole and offset holes adapted for receiving one or more pencils.

In FIG. 4, a perspective view of the centerline marker holder 10 is illustrated for viewing the flat, interior sliding surface 38 of the first and second wall engaging members 26 and 30. In this drawing, a portion of the pencil 18 is shown extending through the centerline hole 32. The pencil 18 is shown with a sharpened point 56 for marking the centerline 20 and the offset lines 52 and 54, as shown in FIG. 2.

Figure 5:
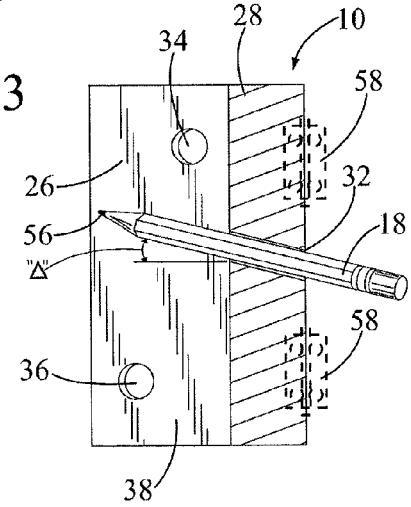
FIG. 5 is a sectional view of the centerline marker holder taken along lines 5-5, shown in FIG. 4.

In FIG. 5, a sectional view of the centerline marker holder 10 is shown and taken along lines 5-5, in FIG. 4. In this view, the centerline hole 32 is shown angled upwardly at an angle "Δ". The angle "Δ" is in a range of 5 to 45 degrees and greater from the horizontal. This angle from the horizontal helps prevent the breaking of the point 56 when drawing the centerline 20 and makes for a smoother marking of the centerline and offset lines by the lead point 56, as the marker holder 10 slides along the length of the rounded and bull nose corners as shown in the drawings.

In this drawing, a portion of a pair of recessed hinges 58 are shown in dashed lines. The hinges 58 are attached to the first and second wall engaging members 26 and 30 at the intersection 28. The feature allows the marker holder 10 to easily be adjusted for the angle Φ between the walls with exterior and interior corners, as shown in the drawings. While the use of hinges 58 are shown herein, it can be appreciated that the wall engaging members 26 and 30 can be made of a flexible material. The flexible material allowing the marker holder 10 to be easily adjusted to the various angles between the exterior or interior walls.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The invention claimed is:

1. A centerline marker holder adapted for engaging and sliding along a portion of a first wall and for engaging and sliding along a portion of a second wall, the first wall disposed at an angle to the second wall, an intersection of the two walls having an exterior or interior rounded or bull nose corner, the marker holder adapted for holding a pencil and like marker for drawing a centerline along a length of the corner, the marker holder comprising:

a flat, first wall engaging member having an interior sliding surface and an exterior sliding surface;

a flat, second wall engaging member having an interior sliding surface and an exterior sliding surface, a first end of the second wall engaging member is attached to a first end of the first wall engaging member and at an angle thereto, this angle corresponds to the angle between the first and second wall, the first and second wall engaging members made of a flexible material, the flexible first and second wall engaging members allowing the marker holder to be easily adjusted to various angles between the first and second wall; and a centerline hole at an intersection of the first end of the first wall engaging member and the first end of the second wall engaging member, the centerline hole adapted for and dimensioned to receive the pencil and the like therethrough for marking the centerline along a length of the corner, the centerline hole angled upwardly from a horizontal to help prevent the breaking of a pencil point on the pencil and for smoother marking of the centerline.

2. The centerline marker holder as described in claim 1 wherein the centerline hole is angled upwardly in a range of 5 degrees and greater from the horizontal.

3. The centerline marker holder as described in claim 1 further including at least one offset hole in the first and second wall engaging members, the offset holes for drawing parallel offset lines at a selected distance from the centerline hole.

4. The centerline marker holder as described in claim 1 further including two offset holes in the first and second wall engaging members, the offset holes for drawing parallel offset lines at a selected distance from the centerline hole.

5. The centerline marker holder as described in claim 1 wherein the first wall engaging member is disposed at a right angle to the second wall engaging member.

6. The centerline marker holder as described in claim 1 wherein the first wall engaging member is disposed at an acute angle to the second wall engaging member.

7. The centerline marker holder as described in claim 1 wherein the first wall engaging member is disposed at an obtuse angle to the second wall engaging member.

8. A centerline marker holder adapted for engaging and sliding along a portion of a first wall and for engaging and sliding along a portion of a second wall, the first wall disposed at an angle to the second wall, an intersection of the two walls having an exterior or interior rounded or bull nose corner, the marker holder adapted for holding a pencil and like marker for drawing a centerline along a length of the corner, the marker holder comprising:

a flat, angular-shaped, first wall engaging member having an interior sliding surface and an exterior sliding surface;

a flat, angular-shaped, second wall engaging member having an interior sliding surface and an exterior sliding surface, a first end of the second wall engaging member is attached to a first end of the first wall engaging member and at an angle thereto, this angle corresponds to the angle between the first and second wall, the first and second wall engaging members made of a flexible material, the flexible first and second wall engaging members allowing the marker holder to be easily adjusted to various angles between the first and second walls;

a centerline hole at an intersection of the first end of the first wall engaging member and the first end of the second wall engaging member, the centerline hole adapted for and dimensioned to receive the pencil and the like therethrough for marking the centerline along a length of the corner, the centerline hole angled upwardly from a horizontal to help prevent the breaking of a pencil point on the pencil and for smoother marking of the centerline; and a first offset hole in the first and second wall engaging members, the first offset hole for drawing a parallel offset line at a selected distance from the centerline, the first offset hole disposed a distance "X" from the centerline hole.

9. The centerline marker holder as described in claim 8 wherein the centerline hole is angled upwardly in a range of 5 degrees and greater from the horizontal.

10. The centerline marker holder as described in claim 8 further including a second offset hole in the first and second wall engaging members, the second offset hole for drawing a parallel offset line at a selected distance from the centerline, the second offset hole disposed a distance "2X" from the centerline hole.

11. A centerline marker holder adapted for engaging and sliding along a portion of a first wall and for engaging and sliding along a portion of a second wall, the first wall disposed at an angle to the second wall, an intersection of the two walls having an exterior or interior rounded or bull nose corner, the marker holder adapted for holding a pencil and like marker for drawing a centerline along a length of the corner, the marker holder comprising:

a flat, angular-shaped, first wall engaging member having an interior sliding surface and an exterior sliding surface;

a flat, angular-shaped, second wall engaging member having an interior sliding surface and an exterior sliding surface, a first end of the second wall engaging member is attached to a first end of the first wall engaging member and at an angle thereto, this angle corresponds to the angle between the first and second wall;

a centerline hole at an intersection of the first end of the first wall engaging member and the first end of the second wall engaging member, the centerline hole adapted for and dimensioned to receive the pencil and the like therethrough for marking the centerline along a length of the corner, the centerline hole angled upwardly from a horizontal to help prevent the breaking of a pencil point on the pencil and for smoother marking of the centerline;

a first offset hole in the first and second wall engaging members, the first offset hole for drawing a parallel offset line at a selected distance from the centerline, the first offset holes disposed a distance "X" from the centerline hole;

a second offset hole in the first and second wall engaging members, the second offset hole for drawing a parallel offset line at a selected distance from the centerline, the second offset hole disposed a distance "2X" from the centerline hole; and a pair of spaced apart hinges, the hinges attached to the first ends of the first and second wall engaging members, the hinges allow the marker holder to quickly adjust to the angle between the first and second walls.

* * * * *